US007412203B2

(12) United States Patent
Valley et al.

(10) Patent No.: US 7,412,203 B2
(45) Date of Patent: Aug. 12, 2008

(54) SYSTEMS, METHODS AND APPARATUS FOR OPERATING A BROADCAST NETWORK

(75) Inventors: Tim Valley, Burnsville, MN (US); Skeet Skaalen, Omaha, NE (US)

(73) Assignee: Excelsior Radio Networks, LLC, New York, NY (US)

( * ) Notice: Subject to any disclaimer, the term of this patent is extended or adjusted under 35 U.S.C. 154(b) by 503 days.

(21) Appl. No.: 10/761,487

(22) Filed: Jan. 20, 2004

(65) Prior Publication Data

US 2005/0159104 A1 Jul. 21, 2005

(51) Int. Cl.
*H04H 20/74* (2008.01)

(52) U.S. Cl. ..... 455/3.02; 455/3.01; 455/3.03; 455/3.06

(58) Field of Classification Search ..... 455/3.02, 455/3.03, 3.01, 427, 414.1, 12.1, 13.2, 98; 725/37–61

See application file for complete search history.

(56) References Cited

U.S. PATENT DOCUMENTS

| | | | | |
|---|---|---|---|---|
| 5,508,733 | A | 4/1996 | Kassatly | |
| 5,694,334 | A | 12/1997 | Donahue et al. | |
| 5,864,546 | A | 1/1999 | Campanella | |
| 5,870,390 | A | 2/1999 | Campanella | |
| 5,923,362 | A * | 7/1999 | Klosterman | 725/48 |
| 6,006,173 | A | 12/1999 | Wiese et al. | |
| 6,049,551 | A | 4/2000 | Hinderks et al. | |
| 6,072,983 | A * | 6/2000 | Klosterman | 725/49 |
| 6,094,671 | A | 7/2000 | Chase et al. | |
| 6,101,180 | A | 8/2000 | Donahue et al. | |
| 6,115,366 | A | 9/2000 | Campanella et al. | |
| 6,160,797 | A | 12/2000 | Robert, III et al. | |
| 6,163,683 | A | 12/2000 | Dunn et al. | |
| 6,201,798 | B1 | 3/2001 | Campanella et al. | |
| 6,212,201 | B1 | 4/2001 | Hinderks et al. | |
| 6,262,982 | B1 | 7/2001 | Donahue et al. | |
| 6,266,339 | B1 | 7/2001 | Donahue et al. | |
| 6,332,163 | B1 | 12/2001 | Bowman-Amuah | |
| 6,385,647 | B1 | 5/2002 | Willis et al. | |
| 6,411,607 | B1 | 6/2002 | Robert, III et al. | |
| 6,411,616 | B1 | 6/2002 | Donahue et al. | |
| 6,477,370 | B1 | 11/2002 | Sigler et al. | |

(Continued)

OTHER PUBLICATIONS

Waitt Radio Networks, "LocalLive—Boomer Oldies", Document No. R1-APL-DL-NAC, Rev. Feb. 17, 2002.

*Primary Examiner*—Matthew Anderson
*Assistant Examiner*—Dominic E Rego
(74) *Attorney, Agent, or Firm*—Jeffer Mangels Butler & Marmaro, LLP

(57) ABSTRACT

In a method for operating a radio station, the radio station periodically receives content files via a satellite data channel. The received content files are stored. At least some of the stored files are then retrieved, played and broadcast in accordance with an electronic schedule. In accordance with another method, a plurality of affiliate radio stations are provided with content files via a satellite-based content delivery system. Each of the affiliate radio stations is also provided with an electronic schedule that instructs an automation system of the affiliate radio station to retrieve, play and broadcast ones of the content files, thereby generating a near real-time radio broadcast. Methods and apparatus for recording said content files for tiers of affiliates, and for recording said content for multiple or singular affiliates, are also disclosed.

18 Claims, 5 Drawing Sheets

U.S. PATENT DOCUMENTS

| | | | | |
|---|---|---|---|---|
| 6,522,635 | B1 | 2/2003 | Bedwell | |
| 6,542,480 | B1 | 4/2003 | Campanella | |
| 6,574,338 | B1 | 6/2003 | Sachdev | |
| 6,574,794 | B1 | 6/2003 | Sarraf | |
| 6,577,716 | B1 | 6/2003 | Minter et al. | |
| 6,590,529 | B2 | 7/2003 | Schwoegler | |
| 6,978,116 | B2 * | 12/2005 | Burr et al. | 455/3.02 |
| 7,076,035 | B2 * | 7/2006 | Loudermilk | 379/101.01 |
| 2001/0025377 | A1 | 9/2001 | Hinderks | |
| 2002/0067730 | A1 | 6/2002 | Hinderks et al. | |
| 2002/0072341 | A1 * | 6/2002 | Ricard et al. | 455/174.1 |
| 2002/0095228 | A1 * | 7/2002 | Corts et al. | 700/94 |
| 2002/0097728 | A1 | 7/2002 | Hinderks et al. | |
| 2002/0105955 | A1 | 8/2002 | Roberts, III et al. | |
| 2002/0132575 | A1 * | 9/2002 | Kesling et al. | 455/2.01 |
| 2002/0141491 | A1 * | 10/2002 | Corts et al. | 375/216 |
| 2002/0194364 | A1 | 12/2002 | Chase et al. | |
| 2003/0018966 | A1 * | 1/2003 | Cook et al. | 725/2 |
| 2003/0070167 | A1 * | 4/2003 | Holtz et al. | 725/32 |
| 2003/0153264 | A1 * | 8/2003 | Osato et al. | 455/3.06 |
| 2004/0244042 | A1 * | 12/2004 | Billmaier | 725/110 |
| 2005/0027449 | A1 * | 2/2005 | Marsh | 701/213 |
| 2005/0028200 | A1 * | 2/2005 | Sardera | 725/42 |
| 2005/0086682 | A1 * | 4/2005 | Burges et al. | 725/19 |
| 2005/0202808 | A1 * | 9/2005 | Fishman et al. | 455/419 |
| 2006/0259926 | A1 * | 11/2006 | Scheelke et al. | 725/48 |
| 2007/0149116 | A1 * | 6/2007 | White et al. | 455/3.06 |

* cited by examiner

File Picker - 22:Country Today

ALL

—ALL—
C1-KBUS
C2-KUQQ
C3-KZRD
C4-KILS
C5-KXOQ
C6-KHBT
C7-KGCX

| | | | Length | Killdate/Artist | Intro | EOM | Type | PlayAt | Net Mode |
|---|---|---|---|---|---|---|---|---|---|
| 1 | | Voice Track | 00.0 | 01/01/2003 | | 02.6 | Auto DnLd 1 | Net | |
| 1 | | Voice Track | 00.0 | 01/01/2003 | | 00.6 | Auto DnLd 1 | Net | |
| 1 | | | 00.4 | | | 00.6 | General Audio | Net | |
| 1 | | et Voice Track | 15.7 | 01/26/2004 | | 05.1 | Auto DnLd LO | Net | |
| 1 | | et Voice Track | 24.5 | 01/26/2004 | | 00.9 | Auto DnLd LO | Net | |
| 1 | | OCAL WEATHER | 22.7 | 01/26/2004 | | 05.3 | Auto DnLd 2 | Net | |
| 1 | | et/LOCAL TIER | 25.9 | 01/26/2004 | | 00.6 | Auto DnLd 3 | Net | |
| 1 | | OCAL WINDOW | 23.1 | 01/26/2004 | | 00.9 | Auto DnLd 1 | Net | |
| 1 | | Voice Track | 1:02.2 | 01/19/2004 | | 00.6 | Auto DnLd 1 | Net | |
| 1 | 0387 | 8am #7 Tues Voice Track | 00.0 | 12/30/2002 | | 01.2 | Auto DnLd 1 | Net | |
| 1 | 0388 | 8am #8 Tues Voice Track | 00.0 | 12/30/2002 | | 04.1 | Auto DnLd 1 | Net | |
| 1 | 0389 | 8am #9 Tues Voice Track | 00.0 | 12/30/2002 | | 02.3 | Auto DnLd 1 | Net | |
| 1 | 0390 | | 00.0 | 12/15/2003 | | 00.3 | Voice Track | Net | |
| 1 | 0391 | 9am #1 Tues Net Voice Track | 15.8 | 01/26/2004 | | 11.0 | Auto DnLd LO | Net | |
| 1 | 0392 | 9am #2 Tues Net Voice Track | 1:00.4 | 01/26/2004 | | 00.2 | Auto DnLd LO | Net | |
| 1 | 0393 | 9am #3 Tues LOCAL WEATHER | 14.0 | 01/26/2004 | | 10.0 | Auto DnLd 2 | Net | |
| 1 | 0394 | 9am #4 Tues Net/LOCAL TIER | 20.5 | 01/26/2004 | | 00.3 | Auto DnLd 3 | Net | |
| 1 | 0395 | 9am #5 Tues LOCAL WINDOW | 30.7 | 01/26/2004 | | 00.2 | Auto DnLd 1 | Net | |
| 1 | 0396 | 9am #6 Tues Voice Track | 00.0 | 10/27/2003 | | 00.6 | Auto DnLd 1 | Net | |
| 1 | 0397 | 9am #7 Tues Voice Track | 00.0 | 01/02/2003 | | 04.7 | Auto DnLd 1 | Net | |
| 1 | 0398 | 9am #8 Tues Voice Track | 00.0 | 01/02/2003 | | 04.7 | Auto DnLd 1 | Net | |
| 1 | 0399 | 9am #9 Tues Voice Track | 00.0 | 01/02/2003 | | 00.6 | Auto DnLd 1 | Net | |
| 1 | 0400 | | 00.0 | | | 00.6 | General Audio | Net | |
| 1 | 0401 | 10am #1 Tue Net Voice Track | 23.8 | 01/26/2004 | | 06.6 | Auto DnLd LO | Net | |

[Click to Name Drive] 44kHz S-MPG WAV 256k 22% Free Path: \\Air-22\AudioD\10000\

FIG. 3

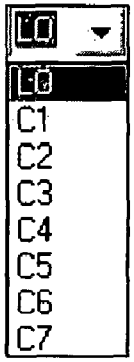

File Picker - 22:Country Today

| File | Name | Length | Killdate/Artist | Intro | EOM | Type | PlayAt | Net Mode |
|---|---|---|---|---|---|---|---|---|
| 0324 | | 00.0 | | | 00.6 | General Audio | Net | |
| 0325 | | 00.0 | | | 00.6 | General Audio | Net | |
| 0326 | | 00.0 | | | 00.6 | General Audio | Net | |
| 0327 | | 00.0 | | | 00.6 | General Audio | Net | |
| 0328 | | 00.0 | | | 00.6 | General Audio | Net | |
| 0329 | | 00.0 | | | 00.6 | General Audio | Net | |
| 0330 | KZRD 4-sec Prod/330/C3 | 05.5 | | | 00.8 | General Audio | Net | |
| 0331 | KZRD 4-sec Prod/331/C3 | 05.5 | | | 00.9 | General Audio | Net | |
| 0332 | KZRD 4-sec Prod/332/C3 | 05.5 | | | 00.8 | General Audio | Net | |
| 0333 | KZRD 4-sec Prod/333/C3 | 05.5 | | | 00.7 | General Audio | Net | |
| 0334 | KZRD 4-sec Prod/334/C3 | 05.5 | | | 00.9 | General Audio | Net | |
| 0335 | KZRD 4-sec Prod/335/C3 | 06.0 | | | 01.2 | General Audio | Net | |
| 0336 | KZRD 4-sec Prod/336/C3 | 06.0 | | | 01.3 | General Audio | Net | |
| 0337 | KZRD 4-sec Prod/337/C3 | 06.0 | | | 01.4 | General Audio | Net | |
| 0338 | KZRD 4-sec Prod/339/C3 | 06.0 | | | 01.2 | General Audio | Net | |
| 0339 | KZRD 4-sec Prod/338/C3 | 06.0 | | | 01.3 | General Audio | Net | |
| 0340 | | 00.0 | | | 00.6 | General Audio | Net | |
| 0341 | | 00.0 | | | 00.6 | General Audio | Net | |
| 0342 | | 00.0 | | | 00.6 | General Audio | Net | |
| 0343 | | 00.0 | | | 00.6 | General Audio | Net | |
| 0344 | | 00.0 | | | 00.6 | General Audio | Net | |
| 0345 | | 00.0 | | | 00.6 | General Audio | Net | |
| 0346 | | 00.0 | | | 00.6 | General Audio | Net | |
| 0347 | | 00.0 | | | 00.6 | General Audio | Net | |

FIG. 4

SYSTEMS, METHODS AND APPARATUS FOR OPERATING A BROADCAST NETWORK

BACKGROUND

A broadcast network, as defined herein, is a network wherein one or more content providers deliver audio, visual, or multimedia content to a plurality of affiliates, each of which broadcasts its received content to a multitude of listeners or viewers. One example of such a broadcast network is a radio network.

Traditionally, the content provider in a broadcast network transmits one or more real-time network feeds to each of the affiliates in its network. Each of the affiliates then amplifies and broadcasts its network feed. Each network feed delivers "network content", and is not localized to the particular market in which an affiliate broadcasts. However, a network feed will typically have a number of predetermined fixed-length "breaks" inserted therein. At each break, the content provider will close one or more relays to switch over to a local broadcast source (or sources). The local broadcast source(s) are then used to air local news, weather, identification information, imaging, spots (i.e., commercials), live feeds and other local content.

SUMMARY OF THE INVENTION

One aspect of the invention is embodied in a method for operating a radio station. In accordance with the method, the radio station periodically receives content files via a satellite uplink. The received content files are stored. At least some of the stored content files are then retrieved, played and broadcast in accordance with an electronic schedule.

Another aspect of the invention is embodied in a method wherein a plurality of affiliate radio stations are provided with content files via a satellite-based content delivery system. Each of the affiliate radio stations is also provided with an electronic schedule that instructs an automation system of the affiliate radio station to retrieve, play and broadcast ones of the content files, thereby generating a near real-time radio broadcast.

A third aspect of the invention is embodied in a radio network comprising a plurality of affiliate radio stations and a content provider. The content provider is linked to the plurality of affiliate radio stations via a satellite-based content delivery system, and provides content to each of the affiliates in the form of discrete content files.

Yet another aspect of the invention is embodied in a radio network origination system. The system comprises a user interface that displays a plurality of content file indicators corresponding to files that are to be distributed to the affiliates of a radio network. At least some of the content file indicators are associated with a tier indication specifying ones of the affiliates that may require a recording of localized content corresponding to the content file indicator. The system also comprises a selector tool that, upon a user's selection of a given content file indicator associated with a given tier indication, provides i) a selection that enables a recording of generic content for all affiliates not requiring localized content for the given content file indicator, and ii) one or more selections that enable a recording of localized content for each of the affiliates of a tier corresponding to the given content file indicator.

A final aspect of the invention is embodied in a radio network origination system. The system comprises a tool to select either a first user interface or a second user interface for recording content files for a plurality of affiliates of a radio network. The first user interface displays a plurality of content file indicators corresponding to files that are to be distributed to the affiliates, and at least some of the content file indicators are associated with a plurality of different files that are to be distributed to different ones of the affiliates. A user may select the content file indicators of the first user interface to initiate the recording of one or more content files for the affiliates. The second user interface is configurable to a selected affiliate, and displays a plurality of content file indicators corresponding to files that are to be distributed to the selected affiliate. A user may select the content file indicators of the second user interface to initiate the recording of content files for the selected affiliate.

Other embodiments of the invention are also disclosed.

BRIEF DESCRIPTION OF THE DRAWINGS

Illustrative and presently preferred embodiments of the invention are illustrated in the drawings, in which:

FIG. 3 illustrates the use of content recording tiers in a graphical user interface (GUI) at the uplink side of the FIG. 1 network;

FIG. 4 illustrates a picker-by-affiliate GUI at the uplink side of the FIG. 1 network.

DETAILED DESCRIPTION OF THE INVENTION

Figure 1:
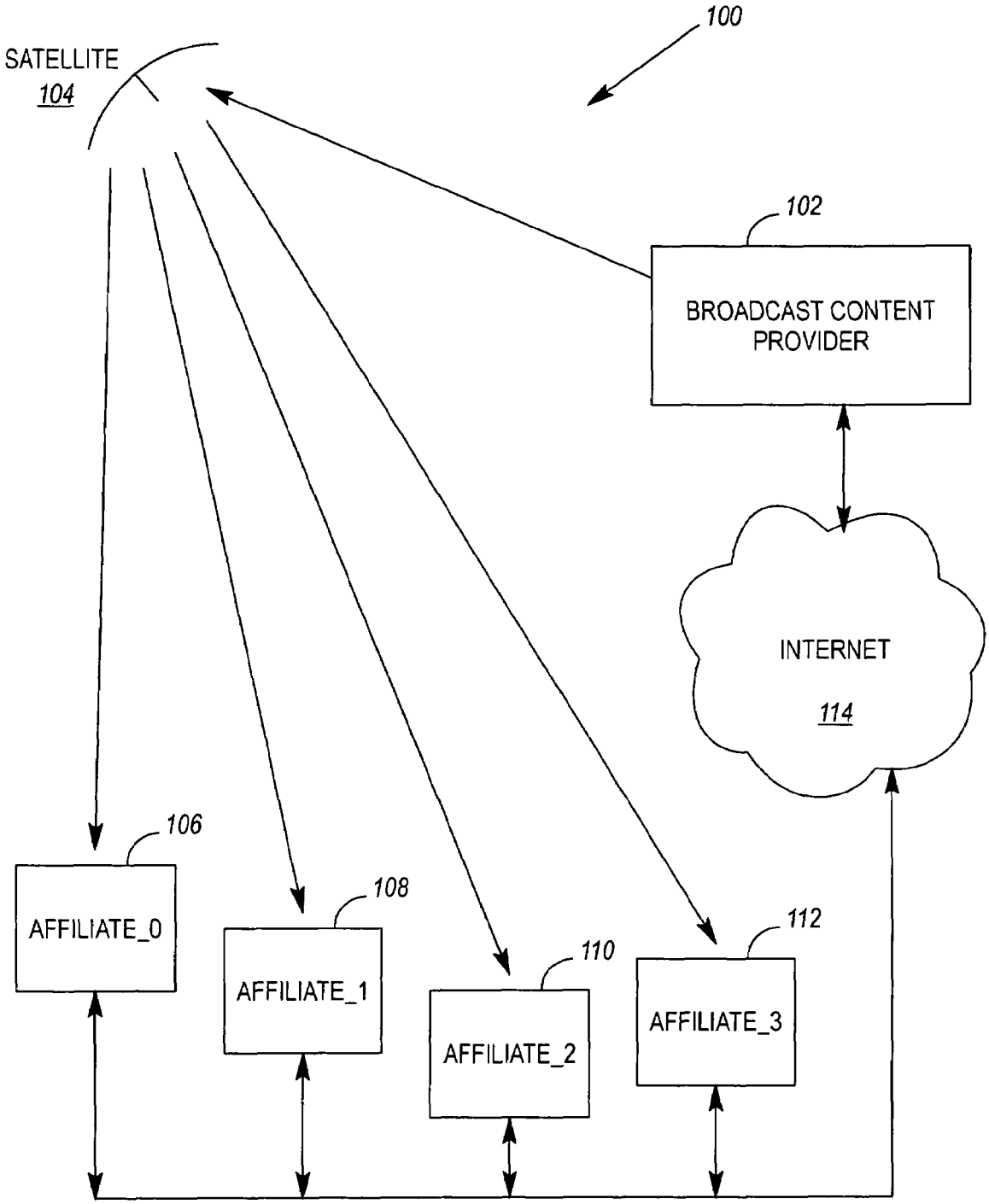
FIG. 1 illustrates a network wherein a broadcast content provider transmits content to each of a number of affiliates via a satellite-based content delivery system.

FIG. 1 illustrates a network 100 wherein a broadcast content provider 102 transmits content to each of a number of affiliates 106, 108, 110, 112 via a satellite-based content delivery system (i.e., via satellite 104). The content is provided to each of the affiliates in the form of discrete content files. Optionally, one or more content files may be "packaged" or "encapsulated" for delivery via the satellite delivery system. However, what is ultimately received by each of the affiliates is a number of discrete content files. After delivery, an automation system at each affiliate retrieves, plays and broadcasts at least some of its received files in accordance with one or more electronic schedules. In this manner, each affiliate generates a near real-time broadcast. As will be explained in more detail later in this description, each affiliate may be provided with different content files and a different electronic schedule (or schedules).

In one embodiment of the network 100, each of the affiliates 106-112 is an affiliate radio station.

Software installed at the content provider's site comprises an origination component, an optional encapsulation component, and a distribution component. The origination component is used by operators of the content provider to record and manage content files that are to be transmitted to the affiliates. The encapsulation component then encapsulates files (or sets of files) into streams of data that are compatible for broadband transmission. Finally, the distribution component delivers the encapsulated files to one or more affiliates via a satellite link. By way of example, the origination component may be implemented using the AirForce™ Digital Audio Automation System distributed by MacroMedia (located in Burnsville, Minn.). The encapsulation component may be implemented using one of the IP Encapsulators distributed by Logic Innovations (located in San Diego, Calif.). The distribution component may be implemented using the Fazzt® Digital Delivery System distributed by KenCast (located in Stamford, Conn.).

The satellite shown in FIG. 1 may be variously embodied, and in one embodiment is a DVB (digital video broadcast) compliant satellite offering one-way communications for the network (i.e., from the content provider to the affiliates). Although DVB compliant satellites are primarily used for streaming video transmissions, discrete files can also be packaged for DVB delivery.

The final element(s) of the network are one or more affiliates. Each affiliate is provided with a satellite receiver and an automation system. In one embodiment, the satellite receiver is the SkyMedia LX2000 Satellite Data Receiver distributed by Telemann (located in San Jose, Calif.). Data files received via an affiliate's satellite receiver are unwrapped and stored. The receipt and storage of files may be facilitated by the KenCast Fazzt® software that was previously mentioned. Once files have been stored, the affiliate's automation system may retrieve, play and broadcast ones of the files in accordance with one or more schedules. By way of example, an affiliate's automation system may be embodied in MacroMedia's AirForce™ software.

In adding a new affiliate to the network 100, an automation computer that is preloaded with a number of useful content files (e.g., music files) may be provided to the affiliate. Up-to-date localized content may then be delivered to the affiliate via the affiliate's satellite link to the content provider.

The network shown in FIG. 1 offers a number of advantages over other networks. For one, satellite delivery of broadcast content is believed to be the most reliable way to quickly deliver near-real-time broadcast content to a plurality of affiliates. Also, the delivery of content in the form of files, in lieu of a media stream, means that real-time quality can be achieved without the need for real-time delivery and the restrictions associated therewith. For example, it is common for broadcast networks to receive a real-time network feed, with predetermined fixed-length breaks in the feed which an affiliate can (really "has to") fill with its own content such as spots, imaging, or identification information. If an affiliate is in a small market that cannot fill all of the breaks with original or meaningful content, then filler music, public service announcements, or possibly repetitive information must be used to fill the breaks. Otherwise, dead air is heard by the affiliate's listeners. With the playback of files, breaks can be dynamically resized based on an affiliate's available content. Thus, sloppy network rejoins are eliminated. Further, the playback of files means that aired content is "first generation", and is not unnecessarily compressed, filtered or relayed before being broadcast to an affiliate's listeners. Typically, first generation content is superior to compressed, filtered or relayed content.

Another advantage of the network is that the storage of files at an affiliate's site means that content is always available for playback. If, for some reason, the satellite link is broken and new content is not received by an affiliate, previously downloaded content is still available for playback.

Yet another advantage of the network is in the content provider's ability to provide different localized content, and any amount of such localized content, to each of the affiliates. Since content is provided to the affiliates as files, there is no common broadcast "media stream" that all of the affiliates must sync to. Emergency announcements, network spots, and other local content may be addressably sent to one, some or all affiliates for network or locally-controlled playback at a scheduled or unscheduled time.

Additionally, the file-centric nature of the network enables a single satellite channel to deliver different sets of content to different affiliates. And, since the content is provided in the form of stored files (and not a real-time media stream), the same content can be played at different times by different affiliates, perhaps to better suit an affiliate's time zone.

The above and other advantages offered by the network will be described in more detail in the following more detailed description of the components of the network.

As previously mentioned, an origination component (or "system") is provided on the content provider side of the network and an automation component (or "system") is provided at each affiliate site. On the uplink side, the origination component provides a means for broadcast personnel (e.g., announcers or "jocks") to record, schedule and manage content such as music, voice tracks, imaging, network spots, and identification information for playback by the affiliates. On the affiliate side, the automation component may provide a similar means for broadcast personnel to record, schedule and manage content. Alternately, the affiliate automation system may simply display a schedule of what is to be played, with limited or even no ability to edit the schedule (depending on the desired degree of automation and local origination that is requested by a particular affiliate).

Figure 2:
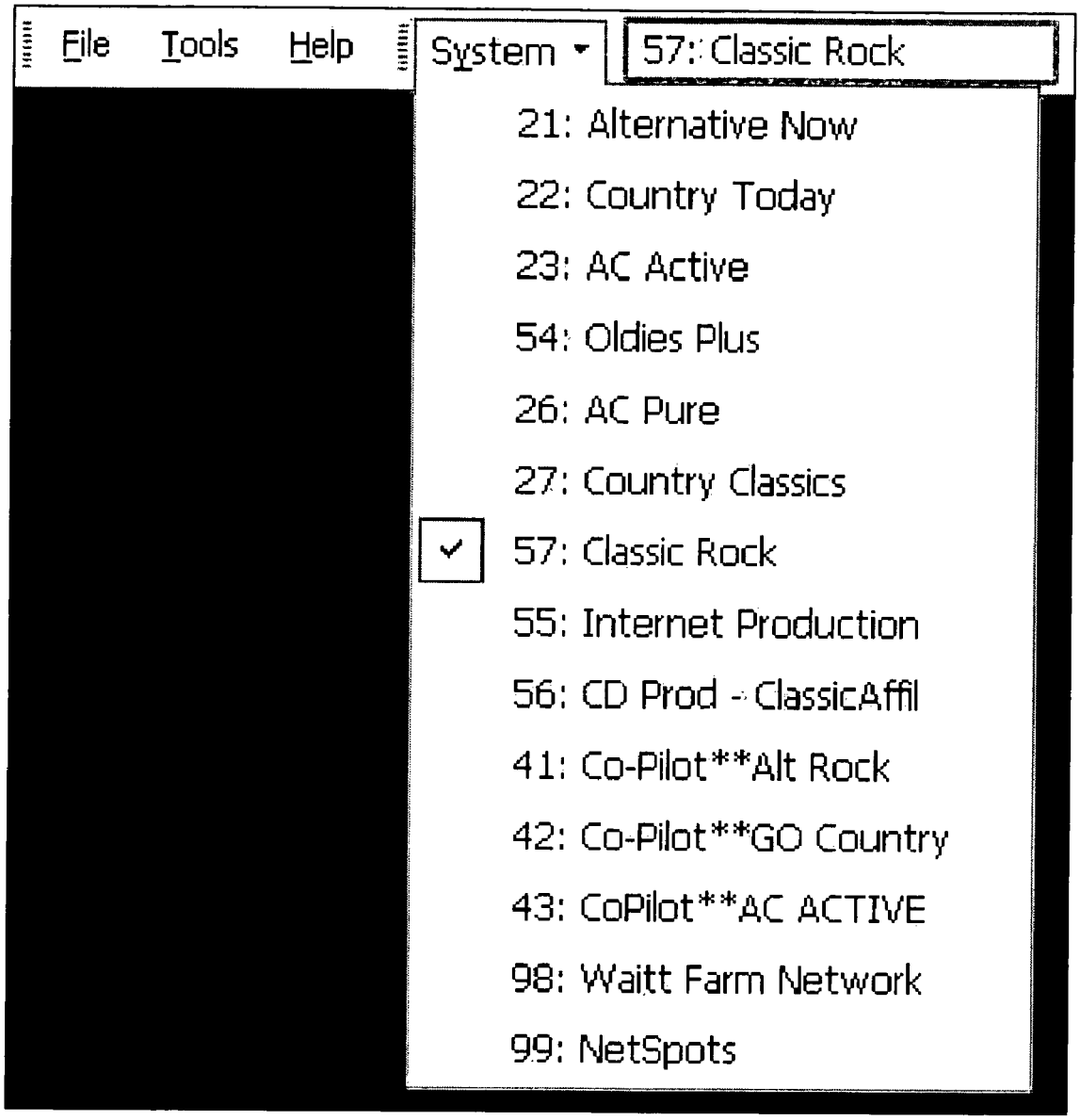
FIG. 2 illustrates the use of a broadcast FORMAT menu item in a user interface at the uplink side of the FIG. 1 network.
Figure 5:
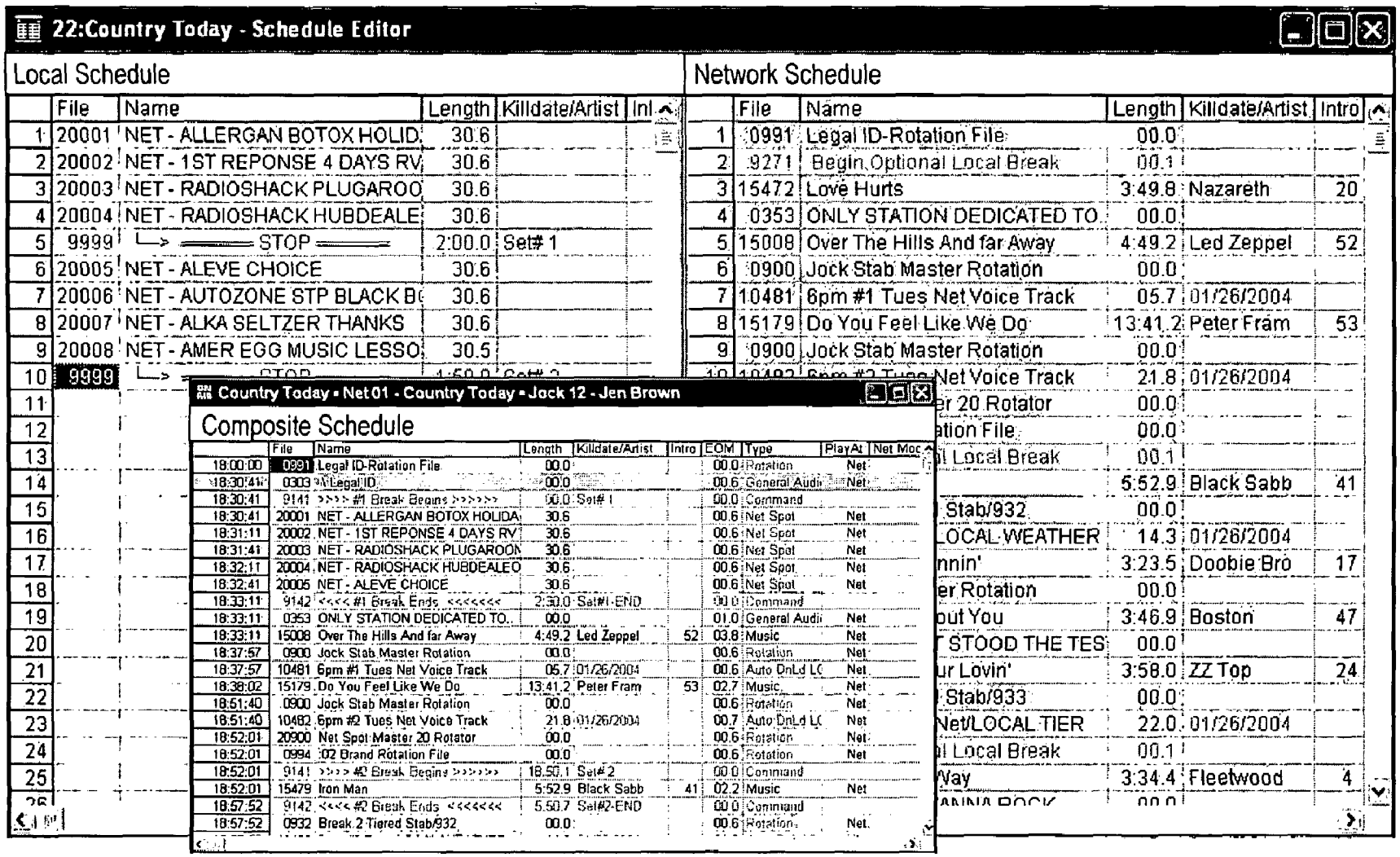
FIG. 5 illustrates a GUI displaying network, local and composite playback schedules at an affiliate of the FIG. 1 network.

On the uplink side, an origination component (or "system") may provide a number of features that enable a jock (or jocks) to more easily record, schedule and manage content. In a radio environment, one useful feature is a "format selection" feature which enables a jock to select a particular format for which he would like to record, schedule or manage content. FIG. 2 illustrates a graphical user interface (GUI) comprising a "broadcast format" menu item. By selecting "System" from the GUI's menu, a jock may select a broadcast format from a drop-down list of available formats. Available formats might include Country, Alternative, Oldies, Adult Contemporary, etc. Upon making a format selection, it is preferable that a jock's origination system make a complete context switch such that file locations, file formats, affiliate lists, logging locations, and possibly even items such as screen colors are updated to reflect the selected format. In this manner, any scheduling, recording, playback or other action undertaken by a jock will be undertaken only for the selected format (and affiliates associated with that format).

Upon selecting a format, a jock may be presented with a user interface displaying one or more lists of "content file indicators", such as file numbers or file names. As shown in FIG. 3, each file number may be mapped to a content type, such as: music, spot, voice track or other content item that might be broadcast by an affiliate. By selecting one of the file numbers, a jock may record or otherwise specify a content item (e.g., a voice track might be recorded, or a music file might be specified) to associate with the file number. Some file numbers might be associated with a single content item, such as a music file that is to be broadcast by all affiliates that broadcast in the selected format. Other file numbers might be associated with multiple content items, such as a plurality of weather updates, each of which is to be distributed to a particular one of a number of affiliates.

To provide a means for more easily recording multiple content items for a given file number, the origination system may implement a "tiered" recording feature. A tier can be programmed to specify a predefined subset of affiliates for which unique content (e.g., localized content) needs to be recorded or provided. For example, one tier (Auto_DnLd_LO) could comprise all affiliates for a particular format; another tier could comprise affiliates that need localized content four times an hour (Auto_DnLd_1); and yet another tier could comprise affiliates that need localized content twice an hour (Auto_DnLd_2). One way to implement such tiers is shown in FIG. 3. Upon selecting a file number associated with a tier indication, a jock is prompted with a selector tool such as a drop-down list. If the selector tool is a drop-down list, the tool may list all of the affiliates in the active tier, in addition to a generic indicator representing all affiliates (designated "LO" in FIG. 3). To record content for a tier, the jock may first select the generic indicator and record or specify generic content for all affiliates that do not require specialized or localized content. The jock may then proceed to the first affiliate in the tier, record content specifically tailored to that affiliate, and then repeat this process for all of the remaining affiliates in the tier. Preferably, once a jock begins recording content for the affiliates of a tier, the origination system automatically and sequentially prompts a jock to record content for each of the affiliates in the active tier (i.e., until content has been recorded for each of the affiliates).

When a jock selects or is prompted to record localized content for an affiliate (e.g., local weather, or a local "calendar of events"), the jock may be automatically prompted with information that helps him identify and relate to the affiliate. For example, when recording localized content for the affiliates in a tier, the jock may be prompted with a first affiliate's callsign, slogan, city, state, time zone and/or other information related to the affiliate (and if a jock is recording content like weather, he may be prompted with local weather information for the affiliate—possibly retrieved from the internet). When the jock finishes recording the content for that affiliate, the jock may be automatically prompted with similar information for the next affiliate, and so on until content has been recorded for all of the affiliates in the tier.

In addition to providing a jock the ability to record content by file number for all affiliates, the origination system may also provide a jock the ability to record files directly into an affiliate's own file system. This may be accomplished using a "file picker-by-affiliate" feature of the origination system (FIG. 4). With file picker-by-affiliate, a jock selects a particular affiliate for which he would like to record voicetracks (e.g., from a drop-down menu). Upon selecting the affiliate, the jock is presented with the files that have been recorded for that affiliate. In one embodiment, the presented files include only those that have been transmitted to the affiliate. Thus, the jock views the same set of files that are available to the affiliate. In another embodiment, the presented files also include files that have been recorded and/or scheduled for delivery to the affiliate.

The files presented in a picker-by-affiliate view are preferably presented in accordance with a file structure that is similar to what a jock sees when recording files for multiple affiliates. When a jock selects a file number in a picker-by-affiliate screen, any recording undertaken by the jock is tagged for delivery to the particular affiliate to which the active picker-by-affiliate screen corresponds.

Preferably, an uplink's origination system is provided with both the interface shown in FIG. 3 and the interface shown in FIG. 4. Via a toolbar or menu bar such as that which is shown in FIG. 2, a jock may then select either of the interfaces (or alternately switch between them).

Upon recording, each content file may be assigned an automatic "kill date". The purpose of the kill date is to prevent an affiliate from playing an out-of-date file. If for some reason a file with an expired kill date is scheduled to be played (e.g., because an updated file was not received by an affiliate), it will be skipped in lieu of the next file scheduled for playback. Typically, only time-sensitive files such as localized voice tracks (weather, news) need to be assigned kill dates.

In one embodiment of the uplink's origination system, files can be sent immediately to the designated affiliate, or stored for later delivery. Certain static files (music and imaging) may be automatically queued on the system for multiple automatic downloads. This ensures that affiliates automatically receive important files.

To ensure that files are downloaded to the appropriate affiliates, the origination system may associate each file with an information "token". A file's associated token may take the form of a text file that describes the source location of the file, its filename, its destination(s) (i.e., one, some or all of the affiliates) and other information. In transferring a file via the satellite, the uplink's distribution system may parse the token to determine where the file needs to be sent. Upon receiving the file, an affiliate may then parse the token to determine where the file should be stored, and what actions, if any, should be taken upon receipt of the file.

The origination system at the uplink may also provide one or more means for creating electronic playback schedules for the affiliates. In one embodiment, a single weekly "network schedule" is created for each broadcast format supported by the network (e.g., country, alternative, etc.). The schedules may specify, by file number or file name, each of the files that is to be played back by an affiliate. Typically, a schedule will have a number of "breaks" for which a jock does not specify any content. As will be described in more detail below, these breaks may be filled with spots and other content that is generated by an affiliate. Some portion of these breaks may also be filled by network spots.

To enable the airing of the same spot at the same time in each of a number of time zones, one type of file that an automation system might use is a "rotation file". A rotation file is a file that is programmed to point to other files based on some sort of qualifying event (e.g., day of week, or time of day). A rotation file may also point to other rotation files which, together, form a tree of nested rotation files. For example, a spot can be scheduled to air at the same time in each of a number of time zones by storing the spot as a file referenced by a time-of-day rotator for each of a number of affiliates. The spot can further be aired at a particular day and time by nesting the afore-mentioned time-of-day rotators within day-of-week rotators.

On the affiliate side, an automation system needs to be able to store and playback received files. This may be done in accordance with one or more electronic schedules. Preferably, one schedule is provided to an affiliate by the content provider (the network schedule) and another schedule is maintained locally by the affiliate (the local schedule). See FIG. 6. The network schedule contains items such as music, voice tracks, imaging, identification information, and spots provided by the network's content provider. The local schedule may be used by operators at the affiliate to schedule locally-produced content such as local commercials. Although news, weather, music and other content could also be locally-produced and included in the local schedule, it is preferable that requests for this sort of information be faxed to the content provider and recorded and scheduled by the network jock so that a consistent presence is maintained by the affiliate.

In order to accommodate multiple playback schedules, an affiliate's automation system can merge the multiple schedules (network and local) to form a composite playback schedule. In one embodiment, a "next hour" of the network and local schedules are merged once each hour. Note that if a common network schedule is provided to affiliates in different time zones, the network schedule may need to be offset with respect to the affiliate's local schedule, prior to merging the network and local schedules.

As previously mentioned, when formatting the network schedule, the content provider may insert one or more "breaks" in the schedule. For example, a common radio break format is one break every fifteen minutes (i.e., four breaks an hour). Typically, each of these breaks is nominally 3.0 to 3.5 minutes in length. In one embodiment, the network schedule specifies optional content that can be aired in lieu of each of these breaks. During merger of the network schedule with the local schedule, a determination is made as to whether a minimum quantity of content is available in the local schedule to fill each break. The minimum quantity may be programmable, and in one embodiment may be equal to ninety seconds (or about half the length of a regularly scheduled break). If the minimum quantity of content is available in the local schedule, the content provided in the local schedule is added to the composite schedule, and the optional content (e.g., one or more music files) is left out of the composite schedule. If the minimum quantity of content is not available in the local schedule, the available locally scheduled content, as well as the optional content are added to the composite schedule. Regardless of whether more or less content is provided in the local schedule, and regardless of whether the optional content is added to the composite schedule, the content files that are placed in the composite schedule are aired back-to-back such that no deadtime (silence) is experienced between the various items that are scheduled to be broadcast.

Preferably, the hourly network schedule specifies more than sixty minutes of content and breaks. In this manner, additional content is available to fill the end of an hour should i) the affiliate have little or no content for each of its breaks, and ii) the optional content provided for each of the breaks be less than what is needed to fully fill each of the breaks. However, if too much more than sixty minutes of content is specified for a given hour, it becomes difficult for a network jock to estimate the likelihood that affiliates are actually airing the items that are scheduled past the sixty minute mark, and thus a jock may be hesitant to schedule those items again in the near future. As a result, it is believed that a jock should ideally specify about sixty-three minutes of content per hour and, if for some unlikely reason there is a shortage of material for an hour, content from the top of the hour can be re-aired at the bottom of the hour. Excess programming will be "dropped" when the following hour's schedule is loaded.

In the past, breaks having irregular or unknown length have caused problems in that a "void" might be left during a break, and filler music of an inconsistent format and fixed duration would have to be plugged in to fill the void. On the flip side, breaks that were too long would have to overlap the playback of content from an unforgiving network feed (or would have to finish airing prior to an affiliate returning to the network feed). Using the schedules and methods for merging schedules described in the above paragraphs, it is very easy for an affiliate to air from 0-4 minutes of locally generated content during a break. Although an affiliate may choose to air more than four minutes of material during a break, doing so creates a risk that one or more breaks may extend into the "next hour". However, in accordance with a preferred embodiment of schedule merging/loading, only those items that begin to air in the current hour are broadcast by the automation system (and once begun, are broadcast in their entirety). Any item that would not begin to air until the next hour is not aired at all—either by leaving the item out of the current hour's composite schedule, or by ignoring the existence of the item in the composite schedule. In one embodiment, an exception is provided such that contiguous commercial content is allowed to carry over into the "new" hour, which is then loaded only after the final commercial-designated program element has been aired.

Some useful features that are provided by flexible breaks are: 1) an affiliate can sell spots of any length, and is not limited to selling precisely timed :30 or :60 second spots that neatly fit within a prescribed break window, and 2) an affiliate can overlap or otherwise merge, edit or position spots, since changing the length of material that is available for a break will not result in dead air, silence or overruns at the end of the break.

If an affiliate would like a network jock to record material for a break, they can call in, fax or email a request for such content to the network's content provider.

As partly described above, an affiliate's automation system may provide a greater or lesser degree of automation for any particular affiliate. One option that some affiliates will want to take advantage of is local "live" broadcasts, or the airing of live network broadcasts such as sports games, on-site publicity events, or press conferences. Such live events may be accommodated using standard relay closures. At a desired point in a network schedule, an affiliate's operator may simply close a desired relay connection or select a different Network configuration setting to "switch over" to a live feed. At the end of a live feed, an affiliate would previously have had to worry about timing a network rejoin. However, since the network described herein is a not a real-time network, the automation system described herein can ease these network rejoins. In one embodiment, an affiliate's automation system provides a "Sync" button as part of its GUI. Upon clicking the Sync button, the automation system determines a sync point in the current hour's composite schedule that is close to the current time in the hour. The sync point may be before or after the sync time. Preferably, the current hour's composite schedule continues to load (but not play) during live broadcasts so that a sync point can be determined relatively quickly. It does not matter if the sync point is before or after the sync time, because as previously stated, only those content items that begin to air in the current hour are broadcast, and any items that do not begin to air in the current hour are dropped as the next hour's schedule begins to play.

To provide redundancy, and to offer a low cost means of implementing a return link to a network's content provider, each affiliate may be equipped with an internet connection. If a satellite delivery channel breaks down, most localized content can be alternately provided to an affiliate via the internet connection, especially if the internet connection is a broadband connection.

As another redundancy, the network may be programmed to automatically and periodically (e.g., once a week) resend files that it was asked to send within a prior time frame (e.g., the last three weeks). In one embodiment, this feature is used to resend all music files, but not time-sensitive localized content.

Note that even if the above redundant delivery processes fail, it is very likely that an affiliate will still continue to broadcast. This is because, at any given time, a large amount of prior and future broadcast content is locally stored by the affiliate. This is not the case with real-time delivery networks.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A method for operating a radio station, comprising:

periodically receiving generic content files via a satellite downlink or an internet connection;

periodically creating locally generated content files; storing all of the received generic and locally generated content files;

using an electronic schedule having at least one or more indicators when certain of the generic content files are to be played and one or more indicators when there is supposed to be a break;

preselecting which, if any, of the locally generated content files will be played during a given break without regard for the length or amount of the locally generated content files;

retrieving, playing and broadcasting at least some of the stored generic content files in accordance with the electronic schedule until a break indicator appears at which time the preselected locally generated content files, if any, for that break are retrieved, played and broadcast until completed;

seamlessly resuming retrieving, playing and broadcasting at least some of the stored generic content files without the need for resynchronization with the electronic schedule or dynamically resizing the content files; and repeating the process.

2. The method of claim 1, wherein the electronic schedule is at least partly derived from a network schedule that is provided to the radio station via the satellite downlink or an internet connection.

3. The method of claim 1, wherein the certain ones of the generic content files that are played in response to an indicator in the electronic schedule are specific to that radio station.

4. A method for operating a radio station network, comprising:

periodically sending generic content files via a satellite downlink or an internet connection to affiliate radio stations;

each affiliate radio station storing the generic content files and storing locally generated content files;

generating and sending an electronic schedule having at least one or more indicators when there is supposed to be a break to each affiliate radio station;

each of the affiliate radio stations preselecting which, if any, of the locally generated content files will be played during a given break without regard for the length or amount of the locally generated content files;

each of the affiliate radio stations retrieving, playing and broadcasting at least some of the stored generic content files in accordance with the electronic schedule until a break indicator appears at which time the preselected locally generated content files, if any, for that break are retrieved, played and broadcast until completed, each of the affiliate radio stations seamlessly resuming retrieving, playing and broadcasting at least some of the stored generic content files without the need for resynchronization or dynamic resizing, and repeating the process.

5. The method of claim 4, wherein said the electronic schedule is regenerated after a predetermined period of time.

6. The method of claim 4, wherein different electronic schedules are provided by the network to the affiliate radio stations, each electronic schedule corresponding to a corresponding radio broadcast format.

7. The method of claim 6, further comprising associating each generic content file with a placeholder to identify the placement of the generic content file in the electronic schedule; and wherein the electronic schedules sent to at least two of the affiliate radio stations having the same radio broadcast format each reference the same placeholders;

the method further comprising:

recording at least two different content files for a given placeholder such that the affiliate radio stations having the same radio format may play a different generic content file periodically for the same placeholder.

8. A radio network, comprising:

a plurality of affiliate radio stations;

a plurality of programming formats, each radio station preselecting which format it will use for its programming;

a generic electronic schedule for all radio stations playing the same format;

the electronic schedule having one or more indicators when there is supposed to be a break;

a plurality of content files provided by the radio network capable of being downloaded by each of the affiliate radio stations, the content files being either localized for particular radio stations or generic for all radio stations playing the same format or a combination of both, the generic content files being capable of being downloaded and stored at any time without regard for scheduling;

a content provider, linked to the plurality of affiliate radio stations via a satellite-based content delivery system, providing the plurality of content files to each of the affiliate radio stations and providing each of the affiliate radio stations with the generic electronic schedule, each radio station having a first automation system which downloads the content files from the content provider applicable to the chosen format and stores them locally, the first automation system sequentially retrieving, playing and broadcasting least some of the plurality of content files in accordance with the electronic schedule;

wherein when the indicator for a break appears in the electronic schedule, each radio station may specify either that none or a preselected individualized amount and time length of locally generated content files shall be retrieved, played and broadcast; such that the first automation system stops sequentially executing the network originated generic content files and causes the locally originated content files of any time length or number which have been preselected by each station to be played during a particular break until they are completed; and wherein at the completion of the playback of the locally generated content files during a given break, the first automation system seamlessly resumes retrieving, playing and broadcasting the generic content files without the need for resynchronization or dynamic resizing.

9. The radio network of claim 8, wherein the content provider uses a one-way link of the satellite-based content delivery system to transfer content files to the affiliate radio stations.

10. The radio network of claim 8, wherein the content provider is further linked to the plurality of affiliate radio stations via a bidirectional internet return link that provides a backup connection for transferring content files to the affiliate radio stations.

11. The radio network of claim 8, wherein the content provider comprises:

an origination component providing operators of the content provider an interface to record and manage content files that are to be transmitted to the affiliate radio stations; and a distribution component to deliver said content files via the satellite-based content delivery system.

12. The radio network of claim 11, wherein the content provider further comprises an encapsulation component to encapsulate said content files prior to their distribution by the distribution component.

13. The radio network of claim 8, wherein the content provider provides content to different ones of the affiliate radio stations using only a single satellite channel of the satellite-based content delivery system.

14. The radio network of claim 8, further comprising a second automation system for separately storing locally originated content; wherein the first automation system stops sequentially executing the network originated content files and either tells the second automation system to begin playing the locally originated content files of any time length or number which have been preselected by each station, wherein the second automation system sequentially plays the locally generated content until it is completed.

15. The radio network of claim 8, wherein the electronic schedule further comprises a plurality of placeholders associated with one or more of the generic content files; and wherein each of the electronic schedules provided to at least two of the affiliate stations having the same radio broadcast format each reference the same placeholders but may play a different content file periodically for the same placeholder.

16. The radio network of claim 8, wherein the electronic schedule further comprises a plurality of placeholders associated with one or more of the generic content files; and wherein each of the electronic schedules provided to at least two of the affiliate stations having a different same radio broadcast format each reference the same placeholders but will play a different content file for the same placeholder.

17. The radio network of claim 8, wherein the generic content files comprise localized generic and non-localized generic files, some of which are played in accordance with indicators placed in the electronic schedule.

18. A radio network, comprising:

a plurality of affiliate radio stations:

a plurality of programming formats, each radio station preselecting which format it will use for its programming;

a generic electronic schedule for all radio stations playing the same format; the electronic schedule having one or more indicators when there is supposed to be a break;

a plurality of content files provided by the radio network capable of being downloaded by each of the affiliate radio stations, the content files being either localized for particular radio stations or generic for all radio stations playing the same format or a combination of both, the generic content files being capable of being downloaded and stored at any time without regard for scheduling;

a content provider, linked to the plurality of affiliate radio stations via a satellite-based content delivery system, providing the plurality of content files to each of the affiliate radio stations and providing each of the affiliate radio stations with the generic electronic schedule; each radio station having a first automation system which downloads the content files from the content provider applicable to the chosen format and stores them locally, the first automation system sequentially retrieving, playing and broadcasting least some of the plurality of content files in accordance with the electronic schedule;

each radio station having a second automation system for separately storing locally originated content; wherein each radio station may specify either that none or a preselected individualized amount and time length of locally generated content files shall be retrieved, played and broadcast during a given break such that when the indicator for a break appears in the electronic schedule, the first automation system stops sequentially executing the network originated generic content files and causes the locally originated content files of any time length or number which have been preselected by each station to be played during a particular break until they are completed; and wherein at the completion of the playback of the locally generated content files during a given break, the first automation system seamlessly resumes retrieving, playing and broadcasting the generic content files without the need for resynchronization or dynamic resizing.

* * * * *